US007614458B2

(12) United States Patent
Gross

(10) Patent No.: US 7,614,458 B2
(45) **Date of Patent: *Nov. 10, 2009**

(54) IGNITION UNIT FOR AEROSOL FIRE-RETARDING DELIVERY DEVICE

(75) Inventor: Marc V Gross, Shorewood, MN (US)

(73) Assignee: Fireaway LLC, Minnetonka, MN (US)

( * ) Notice: Subject to any disclaimer, the term of this patent is extended or adjusted under 35 U.S.C. 154(b) by 166 days.

This patent is subject to a terminal disclaimer.

(21) Appl. No.: 11/279,221

(22) Filed: Apr. 10, 2006

(65) Prior Publication Data

US 2007/0245918 A1 Oct. 25, 2007

(51) Int. Cl.
*A62C 2/00* (2006.01)
*A62C 11/00* (2006.01)

(52) U.S. Cl. ..... 169/43; 169/30; 169/57; 169/84; 102/367; 102/370

(58) Field of Classification Search ..... 169/12, 169/28, 35, 36, 41, 46, 47, 57, 75, 85, 89, 169/26, 29, 30, 43, 84; 102/200, 205, 367, 102/368, 482, 487, 370

See application file for complete search history.

(56) References Cited

U.S. PATENT DOCUMENTS

| | | | | |
|---|---|---|---|---|
| 1,510,843 | A | 10/1924 | Hawkins | |
| 1,588,234 | A | 6/1926 | Kauch | |
| 1,774,952 | A | 9/1930 | Thiecke | |
| 1,878,491 | A | 9/1932 | Goss | |
| 2,838,122 | A | 6/1958 | Hutchinson | |
| 2,873,806 | A * | 2/1959 | Bittner | 169/36 |
| 3,380,383 | A | 4/1968 | Snenepfe, Jr. | |
| 3,613,794 | A | 10/1971 | Naumann et al. | |
| 3,724,381 | A * | 4/1973 | Gawlick et al. | 102/368 |
| 3,785,569 | A | 1/1974 | Helmrich | |
| 3,833,063 | A | 9/1974 | Williams | |
| 4,197,213 | A | 4/1980 | Pietz et al. | |
| 4,436,159 | A | 3/1984 | Revay | |
| 4,843,965 | A * | 7/1989 | Merzals | 102/205 |
| 5,423,384 | A | 6/1995 | Galbraith et al. | |
| 5,425,426 | A | 6/1995 | Baratov et al. | |

(Continued)

FOREIGN PATENT DOCUMENTS

EP 1479414 A1 11/2004

(Continued)

OTHER PUBLICATIONS

"U.S. Appl. No. 11/279,228 Non-Final Office Action mailed Jul. 2, 2007", 11 pgs.

(Continued)

*Primary Examiner*—Steven J Ganey
(74) *Attorney, Agent, or Firm*—Schwegman, Lundberg & Woessner, P.A.

(57) ABSTRACT

An ignition unit for a fire extinguishing assembly has an ignition unit housing with a firing pin disposed within the housing. A spring is coupled to the firing pin, and a restraining device holds the pin in place in the housing. A formed eutectic holds the restraining device in place such that when the eutectic deforms, the firing pin is released and moved by the spring in a desired direction.

19 Claims, 3 Drawing Sheets

U.S. PATENT DOCUMENTS

| | | | |
|---|---|---|---|
| 5,613,562 | A | 3/1997 | Galbraith et al. |
| 5,660,236 | A | 8/1997 | Sears et al. |
| 5,831,209 | A | 11/1998 | Kozyrev et al. |
| 5,865,257 | A | 2/1999 | Kozyrev et al. |
| 5,884,710 | A | 3/1999 | Barnes et al. |
| 5,915,480 | A | 6/1999 | Yemelyanov et al. |
| 5,927,082 | A | 7/1999 | Sidelnikov et al. |
| 5,992,528 | A | 11/1999 | Parkinson et al. |
| 6,024,889 | A | 2/2000 | Holland et al. |
| 6,042,664 | A | 3/2000 | Kozyrev et al. |
| 6,089,326 | A | 7/2000 | Drakin |
| 6,116,348 | A | 9/2000 | Drakin |
| 6,264,772 | B1 | 7/2001 | Drakin |
| 6,622,801 | B1 | 9/2003 | Rondino |
| 6,689,285 | B2 | 2/2004 | Rusin et al. |
| 7,389,825 | B2 | 6/2008 | Gross |
| 7,461,701 | B2 | 12/2008 | Gross et al. |
| 2003/0062175 | A1 | 4/2003 | Olander et al. |
| 2004/0262017 | A1 | 12/2004 | Gaidano et al. |
| 2007/0068683 | A1 | 3/2007 | Pavesi |
| 2007/0163787 | A1 | 7/2007 | Posson et al. |
| 2007/0235200 | A1 | 10/2007 | Gross |
| 2007/0246229 | A1 | 10/2007 | Gross |

FOREIGN PATENT DOCUMENTS

| | | | |
|---|---|---|---|
| GB | 271363 | | 5/1927 |
| GB | 2161379 | | 1/1986 |
| GB | 2299020 | | 9/1996 |
| WO | WO-2008057139 | A2 | 5/2008 |
| WO | WO-2008057139 | A3 | 5/2008 |
| WO | WO-2008/057139 | B1 | 11/2008 |

OTHER PUBLICATIONS

"U.S. Appl. No. 11/279,228 Response to Non-Final Office Action filed Oct. 1, 2007", 17 pgs.

"Non-Final Office Action mailed Sep. 26, 2007 in U.S. Appl. No. 11/279,225", 3 pgs.

"Notice of Allowance Mailed Oct. 18, 2007 in U.S. Appl. No. 11/279,228", 4 pgs.

"A Revolution in Fire Suppression Technology", Pyrogen Corporation SDN BHD, Malaysia, (undated), 6 pgs.

"U.S. Appl. No. 11/279,225, Response filed Jan. 28, 2008 to Non-Final Office Action mailed Sep. 26, 2007", 16 pgs.

"U.S. Appl. No. 11/279,225, Notice of Allowance mailed Mar. 18, 2008", 7 pgs.

"U.S. Appl. No. 11/279,228, Non-Final Office Action mailed Nov. 16, 2007", 6 pgs.

"U.S. Appl. No. 11/279,228, Response filed Dec. 11, 2007 to Office Action mailed Nov. 16, 2007", 11 pgs.

"U.S. Appl. No. 11/279,228, Notice of Allowance mailed Jan. 31, 2008", 7 pgs.

"Micro-K tm Aerosol Technology", © 1997 Ansul Incorporation, (1997), 25 pgs.

"Aero-K® Fire Suppression Systems", *Brochure, Sensor Electronics Corporation*, Minneapolis, MN, USA, (before Jan. 2006), 6 pgs.

"FP-1000M", *Technical Data Sheet, Celanova Limited Fire-Pro®*, (Nov. 27, 2003), 1 pg.

"International Application Serial No. PCT/US2007/00831, Written Opinion mailed Jul. 8, 2008", 8 pgs.

"International Application Serial No. PCT/US2007/00831, Article 19 Amendment mailed Oct. 3, 2008", 7 pgs.

"International Application Serial No. PCT/US2007/008831, Search Report mailed Jul. 8, 2008", 4 pgs.

Gross, M.V., "U.S. Appl. No. 11/279,225 Notice of Allowance mailed Jul. 15, 2008", NOAR, 7pgs.

Fletcher, M., "Fighting Fire with Fire", *Eureka, Findlay Publications Ltd.*, vol. 20, No. 1, (Jan. 1, 2000), p. 17 only.

"International Application Serial No. PCT/US2007/00831, International Preliminary Report on Patentability mailed Oct. 23, 2008", 11 pgs.

* cited by examiner

IGNITION UNIT FOR AEROSOL FIRE-RETARDING DELIVERY DEVICE

BACKGROUND

Fire extinguishing aerosol devices generally have a housing with a discharge opening, a charge for producing a fire-extinguishing aerosol, and an ignition unit. When the ignition unit is operated, the pyrotechnic or solid-fuel charge is ignited, and the gaseous combustion products thereof form the fire extinguishing aerosol that passes through the discharge opening into the fire region and extinguishes the fire. In some prior devices, the ignition unit comprises an igniter positioned on or in the pyrotechnic that ignites when electrically activated or heated to a high temperature, such as that caused by a fire. One problem in causing ignition in this manner is that the igniter must be inside the housing, thus requiring that the container itself reach a high temperature prior to ignition.

Another shortcoming is the necessity to connect electrically operated units to suitable detection devices and releasing panels (cost, maintenance, reliability issues.) In some prior devices, a fuse, such as one composed of cordite extends outside of the container. Such fuses, while igniting in response to a desired temperature, are prone to damage and potential malfunction (fuse is limited to one, high activation temperature—significant damage occurs prior to activation). It is also dangerous to ship fire extinguishing devices which can be undesirably activated during shipment.

In one existing device, a bulb is used to hold a spring loaded pin in place. At a prespecified temperature, the bulb breaks, releasing the pin which ignites the pyrotechnic.

SUMMARY

An ignition unit for a fire extinguishing assembly has an ignition unit housing with a firing pin disposed within the housing. A spring is coupled to the firing pin, and a restraining device holds the pin in place in the housing. A formed eutectic holds the restraining device in place such that when the eutectic deforms, the firing pin is released and moved by the spring in a desired direction.

In further embodiments, a fire extinguishing assembly includes a thermal ignition unit and an aerosol generating unit. The ignition unit in one embodiment comprises a spring loaded piston that is held under spring tension by a formed eutectic, which deforms at a predetermined temperature. When such temperature is reached, the piston is released, and strikes a primer to ignite a desired pyrotechnic in the aerosol generating unit. In a further embodiment, the eutectic is held in place by a restraining clip, which when removed, also releases the spring loaded piston to ignite the pyrotechnic. In one embodiment, the piston strikes a primer, which ignites an ignition mix, which further ignites the pyrotechnic. The ignition mix may be formed of the same material as the pyrotechnic. The primer may be a simple pistol primer in one embodiment, or other means of igniting the ignition mix.

The ignition unit may be releasably engaged with a canister that contains the pyrotechnic. In one embodiment, it is formed with threads for mating with threads on the canister. The ignition unit and canister may ship in an unassembled state, and then be easily assembled at a desired location of use to form the fire extinguishing assembly. Many different size canisters may use the same ignition unit. The inclusion of a restraining clip allows actuation of the extinguishing assembly either mechanically, or in direct response to heat.

In one embodiment, the aerosol generating unit comprises a canister having a housing with aerosol exit ports. A cooling material is supported within the housing above the exit ports. A combustion chamber is provided within the housing above the cooling material. The aerosol forming composition is supported within the housing above the combustion chamber. An ignition mix extends into the aerosol forming composition for igniting the aerosol forming composition.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
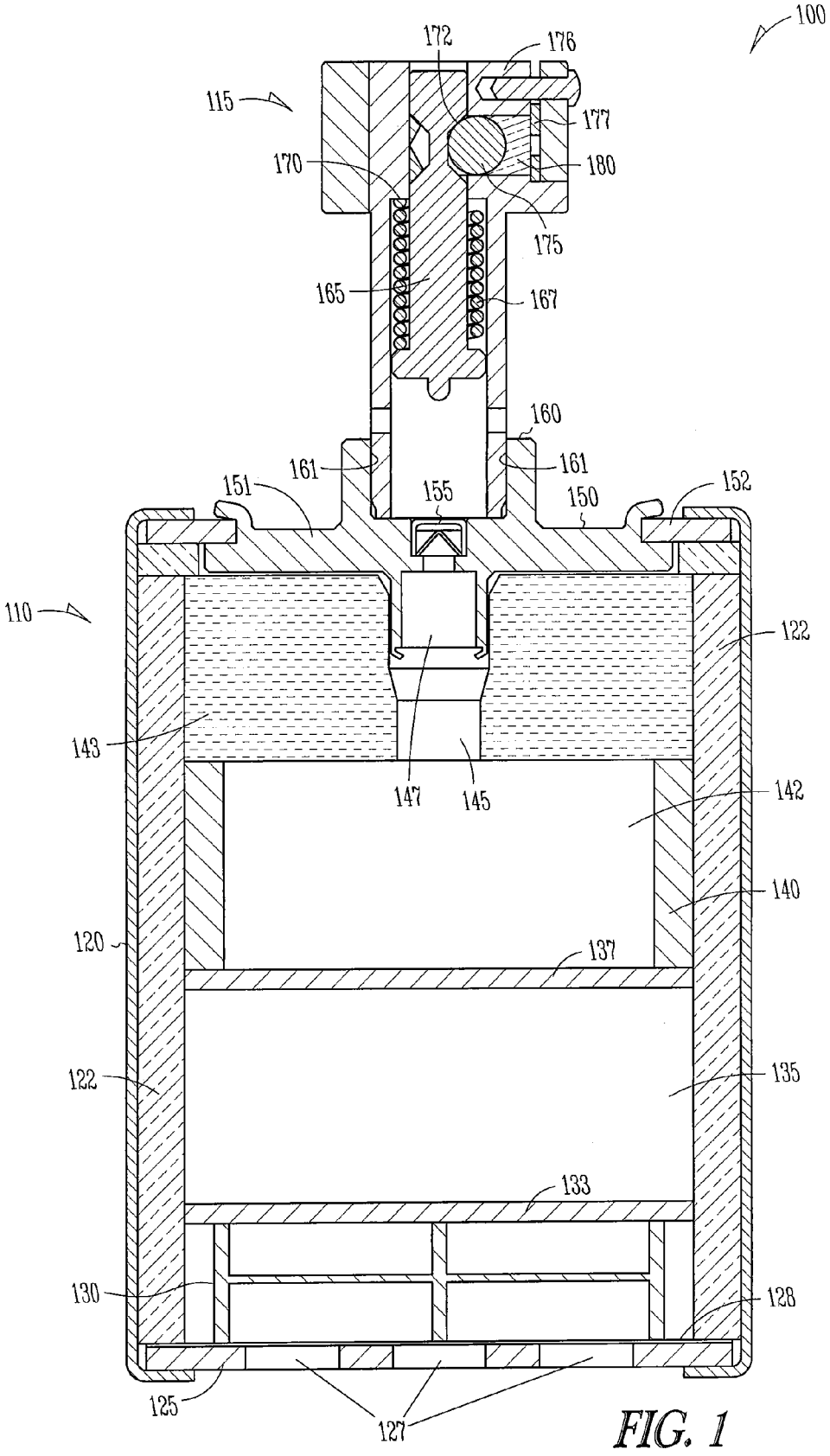
FIG. 1 is a cross section of an ignition unit mounted on an aerosol delivery canister according to an example embodiment.

FIG. 1 shows a cross section of a fire extinguishing assembly indicated generally at 100. The fire extinguishing assembly comprises a canister 110 for coupling with an ignition unit 115. The canister 110 includes a container 120 that may be lined with a desired material 122, such as ceramic paper, or insulative material such as cardboard. Ceramic paper may produce fewer toxic gases such as CO and unwanted odors as compared to other materials. Container 120 contains a bottom piece 125 with exit ports 127. A sealant 128, such as a poly sealant, may be used over the bottom piece 125 to provide an almost hermetic seal for contents inside container 120. A cross member spacer 130 formed of mild steel in one embodiment is positioned within the container 120 between the bottom piece 125. A first screen 133 is positioned adjacent the cross member spacer 130, and supports a cooling material 135, such as pieces of activated alumina, zeolite, marble chips, lava rock etc. In one embodiment, the pieces are approximately $\frac{1}{8}^{th}$ inch to ¼ inch. Many other sizes and types of cooling material may also be used.

A second screen 137 is positioned on top of the cooling material 135, such that the first and second screens hold the cooling material 135 in position. The screens may be formed of stainless steel or other material compatible with the temperatures and other materials used in the canister. Spacer ring 140 formed of mild steel in one embodiment, is positioned on top of the second screen 137, and provides a combustion chamber 142. The spacer ring may be formed of other materials in further embodiments.

The spacer ring 140 also supports a pellet 143 comprising a pressed aerosol forming composition when ignited. The pellet 143 is formed with a hole or opening 145 that contains an ignition mix 147 that is supported within a bushing 150 fastened at a top end of the canister 120. In one embodiment, a cap 151 is sealed with the canister by means of an annular sealant or sealing ring 152. An ignition primer cap 155 is supported by the bushing 150 above the ignition mix 147 for igniting the ignition mix when struck. In a further embodiment, the pellet 143 may be formed without the ignition mix, and directly ignited by the primer cap.

The bushing 150 has an ignition unit receiving portion 160 that extends from the cap 151 and contains a threaded inner portion for receiving a threaded mating outer portion 161 of the ignition unit 115. The receiving portion 160 and mating portion 161 may couple to each other in other ways, such as friction or snap fit. Such coupling may be permanent or releasable in various embodiments.

The ignition unit 115, which in one embodiment is generally cylindrical in shape, has a firing pin 165 slideably mounted within it. The firing pin is coupled to a spring 167 that is compressed against a ledge 170 within the ignition assembly. The firing pin is formed with a detent, groove or annular depression 172 for receiving a restraining device, such as a ball bearing 175 held within a portion 176 of the ignition unit extending generally transverse to the firing pin. Detent 172 may be annular in one embodiment to allow ease of manufacture, removing the need to properly align the pin 165 prior to insertion of the ball bearing 175. In further embodiments, only a portion of the pin has the detent.

The groove 172 may have angled edges, allowing the ball bearing 175 or other stiff structure to move transversely away from the firing pin when no longer held against it. A restraining clip 177 fastened in the transverse extending portion of the ignition unit holds a formed eutectic 180, against the restraining device 175. The eutectic 180 is selected to deform at a desired temperature, releasing the restraining device 175, allowing the spring 167 to drive the firing pin into the ignition primer cap 155. The primer cap 155 will then fire, igniting the ignition mix 147 and in turn the pellet 143. Aerosol from the pellet 143 passes through the screens and cooling material 135, and cross member spacer 130, breaks open the sealant 128 and exits via exit ports 127. In one embodiment, the ignition temperature of the pellet is approximately 270 to 300° C., or other desired temperature which is a function of the chemical composition and method of preparation of the pellet.

In one embodiment, the bushing 150 is part of the ignition unit, and couples to the canister. The bushing 150 includes the primer and ignition mix, and may be shipped separately from the canister, and assembled when ready to use.

In one embodiment, the pellet 143 is formed of a composition comprising potassium nitrate (67-72), dicyandiamide (9-16), phenolformaldehyde resin (8-12), and potassium benzoate, bicarbonate or hexacyanoferrate (4-12) in various percentages by mass as indicated in parentheses. Various other compositions may be used, some of which are described in U.S. Pat. Nos. 6,042,664 and 6,264,772.

The size of the canister may be varied significantly to provide different amounts of aerosol producing material. In one embodiment, the mating threaded portions where the canister and ignition unit attach are the same size for the various sizes of canisters. Thus, a canister designed for inside a cabinet may be fairly small, such as smaller than a can of soda. Canisters designed for larger applications, such as retarding fires in a room, may be very large. All the canisters may use the same size ignition unit provided they are designed to attach to each other through the use of mating threaded portions, or other physical coupling mechanisms.

Figure 2:
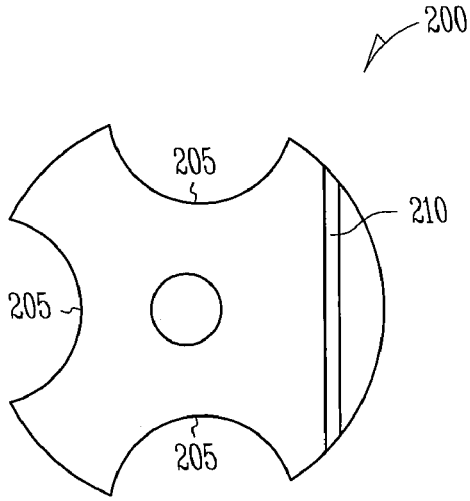
FIG. 2 is a top view of a firing pin for use in the ignition unit of FIG. 1 according to an example embodiment.

A top view of the ignition unit 115 is shown in FIG. 2 at 200. Several grooves may be cut into the top portion of the ignition unit as indicated at 205 to reduce the amount of material in the ignition unit 115, and thereby increase the responsiveness of the ignition unit to temperature changes. FIG. 2 also better illustrates a slot 210 for retaining clip 177.

Figure 3:
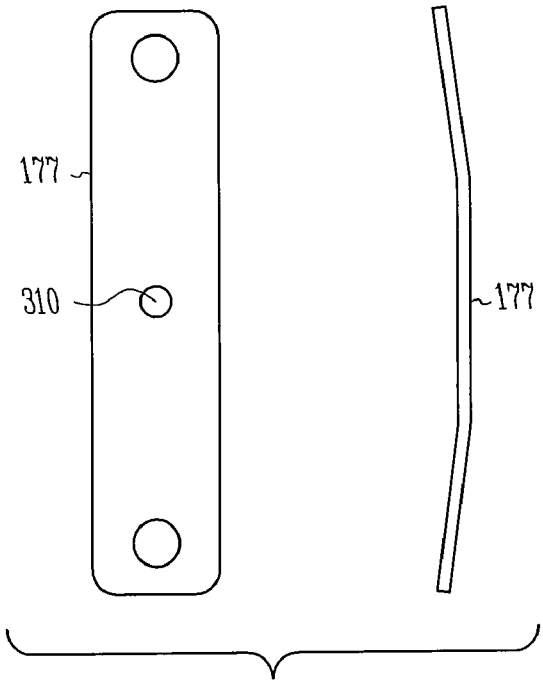
FIG. 3 is a top and side view of a retaining clip for retaining a formed eutectic according to an example embodiment.
Figure 4:
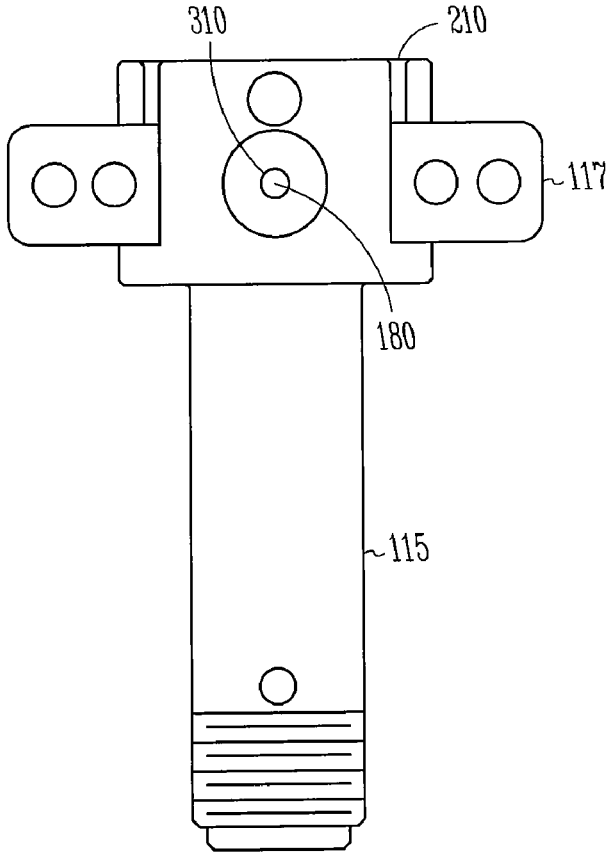
FIG. 4 is a side view of the firing pin of FIG. 2, and including the retaining clip of FIG. 3 for retaining a formed eutectic according to an example embodiment.
Figure 5A:
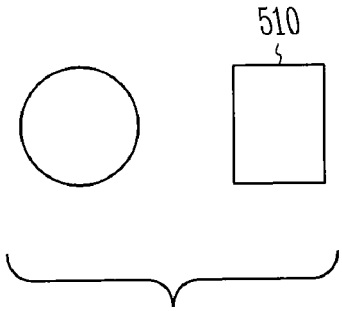
FIGS. 5A and 5B illustrate a eutectic pellet in raw form and after it has been formed for use in the firing pin of FIG. 2 according to an example embodiment.
Figure 5B:
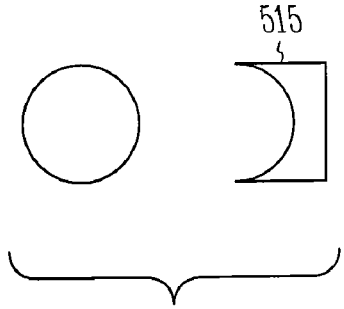

The slot is positioned to hold the retaining clip, shown in detail in FIG. 3 with side and top views, in a desired position as illustrated in a side view of the ignition unit with clip 177 installed in FIG. 4. FIG. 3 shows the retaining clip formed with a middle flat portion having a hole 310 formed therein. As seen in FIG. 4, hole 310 lines up with the formed eutectic 180, and provides a passage for the eutectic to flow through when heated, without allowing it to flow through when below the deformation temperature. Further holes may be formed in portions of the clip 177 as desired to allow attachment of cords or string for manual pulling of the clip 177. FIGS. 5A and 5B illustrate the eutectic prior to installation at 510 and shaped for installation at 515 respectively. Shaping of the eutectic may be done with a ball bearing under pressure. In one embodiment, suitable eutectic pellets 510 may be obtained from Cerro Metal Products Co., Bellefonte Works, P.O. Box 388, Bellefonte, Pa. 16823, or from other sources as desired. Available example melting temperatures include but are not limited to 158, 174, 198 and 203° F. In further embodiment, the eutectic deform at temperatures in the range of approximately 70° C. or lower, or much higher, such as 270 to 300° C., and just about anywhere between.

With the eutectic 180 formed or shaped as shown in FIG. 1, and a ball bearing 175 of substantially the same shape and diameter as the opening, the eutectic is prevented from further deforming at temperatures lower than its melting point, as there is no route available to it to deform into. The hole 310 in the clip is small enough to prevent significant flow, thus securing the pin in place until the eutectic 180 reaches a melting temperature. At that time, the eutectic flows through the hold in the clip, allowing the ball bearing to move away from the detent in the firing pin, and releasing the firing pin to ignite the pellet 143.

The Abstract is provided to comply with 37 C.F.R. §1.72(b) to allow the reader to quickly ascertain the nature and gist of the technical disclosure. The Abstract is submitted with the understanding that it will not be used to interpret or limit the scope or meaning of the claims.

The invention claimed is:

1. An ignition unit for a fire extinguishing assembly, the ignition unit comprising:

an ignition unit housing;

a firing pin disposed within the housing;

a spring coupled to the firing pin;

a restraining device holding the firing pin in place in the housing;

a formed eutectic holding the restraining device in place such that when the eutectic deforms, the firing pin is released and moved by the spring in a desired direction; and a restraining clip positioned to hold the formed eutectic in place.

2. The ignition unit of claim 1 and further comprising a first end that attaches to a fire extinguishing assembly canister such that the firing pin moves toward the canister.

3. The ignition unit of claim 1 wherein the restraining clip is removable, causing the eutectic to move and the firing pin to move.

4. The ignition unit of claim 1 wherein the firing pin comprises a groove, and the restraining devices comprises a ball bearing held in the groove by the formed eutectic.

5. The ignition unit of claim 4 wherein the ball bearing and eutectic are positioned in a passage of the ignition unit transverse to the firing pin.

6. The ignition unit of claim 5 wherein the groove is angled to leverage the ball bearing outward from the transverse passage.

7. The ignition unit of claim 1 wherein the spring is in compression against a flange of the inside of the housing while the firing pin is being held in place.

8. The ignition unit of claim 1 wherein one end of the firing pin is shaped to set off a primer cap when the firing pin is released and moved by the spring.

9. An ignition unit for a fire extinguishing assembly, the ignition unit comprising:

an ignition unit housing;

a firing pin disposed within the housing;

means for moving the firing pin;

means for preventing movement of the firing pin including a ball bearing and a releasable clip; and means for releasing the firing pin at a predetermined temperature to allow it to be moved by the means for moving the firing pin.

10. The ignition unit of claim 9 wherein the means for releasing the firing pin comprises a formed eutectic.

11. The ignition unit of claim 9 wherein the formed eutectic deforms at temperatures in the range of approximately 70° C. to approximately 300° C.

12. The ignition unit of claim 9 and further comprising means for releasably attaching the ignition unit to an aerosol delivery canister.

13. A method of actuating a firing pin to ignite an aerosol based fire extinguisher, the method comprising:

holding a firing pin under tension in an ignition unit housing with a formed eutectic, the formed eutectic holds a ball bearing against a detent in the firing pin;

such that when the formed eutectic reaches a desired temperature, it deforms allowing the ball bearing to move out of the detent, releasing the firing pin such that the firing pin contacts a primer cap, which ignites an ignition mix.

14. The method of claim 13 wherein the formed eutectic deforms at temperatures in the range of approximately 70° C. to approximately 300° C.

15. The method of claim 13 and further comprising moving the firing pin with a spring.

16. A method of forming an ignition unit for an aerosol based fire extinguisher, the method comprising:

placing a firing pin having a detent under spring tension;

positioning a restraining device against the detent; and positioning a formed eutectic adjacent to the restraining device, the formed eutectic:

in a first state holds the restraining device in place, and in a second state at a desired temperature the eutectic deforms, the restraining device moves out of the detent, and the firing pin is acted upon by the spring tension.

17. The method of claim 16, wherein the formed eutectic deforms at temperatures in the range of approximately 70° C. to approximately 300° C.

18. The method of claim 16, wherein positioning the restraining device against the detent includes positioning a ball bearing against the detent.

19. The method of claim 16, wherein positioning the formed eutectic adjacent to the restraining device includes engaging the formed eutectic with the restraining device.

* * * * *

UNITED STATES PATENT AND TRADEMARK OFFICE

CERTIFICATE OF CORRECTION

PATENT NO. : 7,614,458 B2
APPLICATION NO. : 11/279221
DATED : November 10, 2009
INVENTOR(S) : Marc V Gross It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 380 days.

Signed and Sealed this

Nineteenth Day of October, 2010

David J. Kappos

David J. Kappos
*Director of the United States Patent and Trademark Office*